US008408979B2

(12) United States Patent
Abe et al.

(10) Patent No.: US 8,408,979 B2
(45) Date of Patent: Apr. 2, 2013

(54) COMPACT COIN HOPPER

(75) Inventors: Hiroshi Abe, Saitama (JP); Toru Takeuchi, Saitama (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 140 days.

(21) Appl. No.: 13/095,721

(22) Filed: Apr. 27, 2011

(65) Prior Publication Data

US 2011/0269385 A1 Nov. 3, 2011

(30) Foreign Application Priority Data

Apr. 30, 2010 (JP) ..... 2010-105027

(51) Int. Cl.
*G07D 1/00* (2006.01)

(52) U.S. Cl. ..... 453/57

(58) Field of Classification Search ..... 453/33, 453/49, 57; 221/222, 231
See application file for complete search history.

(56) References Cited

U.S. PATENT DOCUMENTS

| | | | |
|---|---|---|---|
| 4,881,919 | A | 11/1989 | Dabrowski |
| 4,997,405 | A | 3/1991 | Dabrowski |
| 5,061,222 | A | 10/1991 | Suris |
| 5,098,339 | A | 3/1992 | Dabrowski |
| 5,316,517 | A | 5/1994 | Chiba et al. |
| 5,562,536 | A | 10/1996 | Uchida et al. |
| 5,607,352 | A | 3/1997 | Tani |
| 5,695,395 | A | 12/1997 | Ota et al. |
| 5,868,614 | A | 2/1999 | Hirano |
| 5,924,919 | A | 7/1999 | Hirano |
| 6,193,599 | B1 | 2/2001 | Kurosawa et al. |
| 6,210,264 | B1 | 4/2001 | Richardson |
| 6,273,809 | B1 | 8/2001 | Bell et al. |
| RE37,662 | E | 4/2002 | Uchida et al. |
| 6,569,006 | B1 | 5/2003 | Kurosawa et al. |
| 6,656,033 | B2 | 12/2003 | Abe et al. |
| 6,695,690 | B2 | 2/2004 | Kurosawa |
| 6,743,087 | B2 | 6/2004 | Abe et al. |
| 7,294,051 | B2 | 11/2007 | Bell |
| 2003/0024791 | A1 * | 2/2003 | Kurosawa et al. ..... 194/302 |
| 2005/0003750 | A1 * | 1/2005 | Inuki et al. ..... 453/57 |

* cited by examiner

*Primary Examiner* — Mark Beauchaine

(57) ABSTRACT

The compact coin hopper for holding and dispensing coins in bulk includes a rotable disk for releasing individual coins to a sliding base beneath the rotable disk for ejection from the coin hopper. The upper surface of the rotable disk includes an upper step part and a lower step part connected by a riser part. The upper step part has a crescent arc shape with a radii smaller than the radius of the rotating disk in a planar view. One end of the crescent arc shape terminates adjacent an edge of the through hole while the other end of the crescent arc shape diverges away from the through hole and terminates adjacent a peripheral side edge of the lower step part. The configuration of the upper and lower step parts and the riser part assist in dispensing a coin.

15 Claims, 20 Drawing Sheets

(A)

(B)

COMPACT COIN HOPPER

BACKGROUND OF THE INVENTION

RELATED APPLICATIONS,

The present applicaton claims priority from Japanese Patent Application No. 2010-105027 filed on Apr. 30, 2010.

1. Field of the Invention

The present invention relates to an economical coin hopper which can drop coins to be released via a through hole in a rotatable disk at the bottom of a hopper container to divide and dispense bulk stored coins one by one. Particularly, the invention relates to a compact small coin hopper in which a diameter of the rotatable disk is only approximately two times a diameter of the coins to be dispensed and the coin hopper is capable of reliably dropping single coins in the through hole by an upper configuration of the rotatable disk.

2. Description of Related Art

A small coin hopper is employed in a recycling-type coin receiving/dispensing device (for example, see Japanese Unexamined Patent Application Publication No. 2003-196695) of a vending machine or in a change dispensing machine (for example, see Japanese Patent Application Laid-Open Publication No. H7-306965) of coins at a cash register of a supermarket.

The size of the small coin hopper employed therein is limited due to the problem of installation space. If the diameter of coins is large, the diameter of a rotatable disk becomes approximately two times that of a through hole, and only one through hole is provided.

There is also a device in which a circular bottom hole of a cylindrical hopper head, which holds coins in bulk and is rectangular in a planar view, is provided with one through hole, an inclined rotatable disk is disposed thereat, and the coins are dropped one by one in the through hole while agitating the coins by rotation of the rotatable disk to dispense the coins one by one (for example, see Japanese Unexamined Patent Application Publication No. 2002-133485). The upper surface of the rotatable disk is approximately flat although the upper surface is provided with a semispherical small projection.

A second small coin hopper has a circular bottom hole of a cylindrical hopper head, which holds coins in bulk and is rectangular in a planar view, is provided with a partially-cut-away through hole, an inclined rotatable disk is disposed thereat, and the coins are dropped one by one in the through hole while agitating the coins by rotation of the rotatable disk to dispense the coins one by one (for example, see U.S. Pat. No. 7,294,051). The upper surface of the rotatable disk is also approximately flat, although the upper surface is provided with a small projection.

A third small coin hopper also has a circular bottom hole of a cylindrical hopper head, which holds coins in bulk and is rectangular in a planar view and is provided with one through hole at a center. A rotatable disk having arched sidewalls which are in contact with the through hole is disposed thereat, and the coins are guided to the through hole by the arched sidewalls and dropped one by one to the through hole while agitating the coins by rotation of the rotatable disk to dispense the coins one by one (for example, see Japanese Patent Application Laid-Open Publication No. H05-081506). An upper surface of the agitating disk, serving as the rotatable disk, is formed into two levels, i.e., an upper step part and a lower step part, and is connected by a wall surface perpendicular to the disk surface.

A prior art hopper is shown with reference to FIG. 20. A rotatable disk 9 in which one through hole 7 is formed is rotatably disposed in the upper-surface side of an obliquely-disposed base 1 and in a circular bottom hole 5 of a hopper head 3, which is cylindrical in the vertical direction. In the bottom hole 5 of the hopper head 3, the inner peripheral surface immediately above the periphery of the rotatable disk 9 is formed in a tapered shape narrowed toward the rotatable disk 9, thereby forming a flange 11 projecting immediately above the periphery of the rotatable disk 9.

A projection 13 is formed on the upper surface of the rotatable disk 9. Therefore, when the rotatable disk 9 is rotated, coins C in the hopper head 3 are agitated by the through hole 7 and the projection 13 and drop to the through hole 7, the coin is moved together with the rotatable disk 9 while the lower surface thereof is in contact with the upper surface of the base 1, and the coin is dispensed at a predetermined position.

Since only one through hole 7 is in the rotatable disk 9, the chance that the coin C is dropped to the through hole 7 is once per one rotation of the rotatable disk 9. Therefore, if no coin is dropped within two rotations of the rotatable disk 9, the customer may feel a delay. The flange 11 is provided, therefore, the coin C is prevented from being placed on a peripheral part of the rotatable disk 9, which contributes to quick dispense of the coin C.

However, as shown in FIG. 20, in the case of the coin C that is leaning on the sidewall of the hopper head 3 by the upper end thereof and standing so as to form an approximately right angle with respect to the base 1 and the rotatable disk 9 in the lowermost part of the slope of the rotatable disk 9, the attempt to topple the coin C is made by instabilizing the posture thereof by dropping the coin from the upper surface of the rotatable disk 9 onto the upper surface of the base 1 or moving the coin from the base 1 onto the rotatable disk 9.

However, the large-diameter coin C having a diameter approximately half that of the rotatable disk 9 may be not toppled by an instabilization of such a posture in many cases, and, sometimes, the last one coin is not dispensed, and dispensing of the coins is stopped due to running out of time.

Therefore, it is conceivable to topple the coin C by increasing the instability of the behavior of the coin when the coin C is moved onto the upper surface of the rotatable disk 9 by increasing the thickness of the rotatable disk 9 (indirectly, the distance from the base 1 to the upper surface of the rotatable disk 9).

However, in the case in which the thickness of the rotatable disk 9 is increased to or higher than a predetermined value, if the coin C is toppled over sideways in the state the coin C is perpendicular to the base 1 and becomes like a pillar, the coin cannot be removed from the through hole 7 and is moved together with the rotatable disk 9, and the coin C may not be dispensed.

Due to these circumstances, the thickness of the rotatable disk 9 cannot be increased to or higher than the predetermined value, therefore, as described above the last one coin may not be dispensed. Furthermore, in the case in which the upper surface of the rotatable disk 9 is flat, coin bridging is generated as shown by chain lines in FIG. 20, and the coin C held therein may not be dispensed.

The Japanese Laid-Open Publication No. HO5-081506 has a problem in that the device is not suitable for downsizing to a compact configuration since the through hole of the coin is at the center, and the diameter of the rotatable disk has to be increased when a diameter of the coins to be released is increased. Furthermore, in the case in which a step between the lower step part and the upper step part is at a right angle, a coin may get stuck between the step and the wall surface of the hopper head, and coin jamming in which the rotatable disk cannot be rotated may occur.

SUMMARY OF THE INVENTION

A first object of the present invention is to provide a coin hopper which is a small coin hopper capable of dispensing all coins including the last coin without generating coin bridging.

A second object of the present invention is to provide a coin hopper which is a small coin hopper which does not generate coin jamming.

A third object of the present invention is to provide a coin hopper at a low cost which is a small coin hopper capable of dispensing all coins in the hopper including the last coin by a simple structure without generating a jamming coin bridging problem. Furthermore, it is an object to produce the small coin hopper at a low cost.

The "coins" used in the present specification include coins serving as currencies, substitutional coins such as medals and tokens of game machines, and similar objects.

The "small hopper" refers to a coin hopper in which the diameter of the rotatable disk is approximately two times that of the through hole, and the number of the provided through hole is only one.

In order to achieve these objects, the present invention is constituted in the below manner.

A coin hopper having a tubular hopper head holding coins in bulk, a rotatable disk disposed in a bottom hole of the hopper head, having a through hole through which a coin can pass through from an upper surface to a lower surface and a coin pushing part being inclined at a predetermined angle. The rotatable disk has a diameter approximately less than two times that of the through hole, and a slide base disposed below and parallel to the rotatable disk. A coin pushed by a pushing part slides on the slide base. The rotatable disk has an at least two-step structure of an upper step part and a lower step part having a step interconnected by an inclined riser surface. The through hole is formed at an eccentric position of the rotatable disk in the lower step part. The riser forms an arc shape having a radius smaller than a radius of the rotatable disk in a planar view and having a center on the rotatable disk so that the upper step part forms a crescent shape in a planar view. An end of the arc is in contact with the through hole, and an intermediate part of the arc is disposed in a peripheral side from the axis of the rotatable disk.

The coin hopper, wherein, a projection is formed on an upper step part and wherein the peripheral side of the upper step part is formed to be conical and forms an inclined surface with respect to a flat surface of the upper step part.

The coin hopper, wherein, if a dispensing signal to release a coin is not outputted within a predetermined period of time upon forward rotation of the rotatable disk, the rotatable disk is automatically reversely rotated and, in the direction of a reverse rotation, the upper step part in contact with the through hole is positioned ahead in the rotation direction, and the lower step part is positioned behind in the rotation direction.

According to this construction, a single through hole of approximately half the diameter of the rotatable disk and is formed at an eccentric position offset from the rotational axis of the rotatable disk, a crescent-shaped upper step part and a rugby-ball-shaped lower step part are formed on the upper surface of the rotatable disk. A riser part therebetween is connected by an inclined surface inclined with respect to a lower step part and the upper step part. The first end part of the inclined surface is in contact with a periphery of the through hole. When the rotatable disk rotates, the coin on the rotatable disk is agitated by the step since the step is formed between the upper step part and the lower step part on the upper surface of the rotatable disk, therefore, coin bridging does not readily occur.

Moreover, the through hole is formed at an eccentric position on the lower step part. In other words, the thickness of the rotatable disk at the part where the through hole is formed can be reduced to a predetermined value or lower. In a the case in which the thickness of the rotatable disk around the through hole is equal to or lower than a predetermined value, the coins are not toppled over sideways and may line up like a pillar in the through hole, therefore, coins can be prevented from not being dispensed due to this problem.

Furthermore, when a coin is about to get stuck between an inclined surface of the step and the hopper head, the coin acts with a predetermined angle with respect to the inclined surface, therefore, the coin slides on the inclined surface and is prevented from getting stuck so that coin jamming does not occur.

The present invention is composed of a crescent-shaped upper step part, a lower step part, and a riser step composed of an inclined surface therebetween. It can be easily produced for example, by a sintering method, and an equivalent resin molded product can be provided at low cost.

A projection is formed on the upper step part, therefore, the coin can be agitated by the projection in addition to agitation by the upper step part and the lower step part. Therefore, the coin can be further agitated, and quickly drop the coins to the through hole to dispense it.

A peripheral side of the upper step part is formed to be conical, therefore, the space expanding upward is formed between the flange and the peripheral surface and continues to the upper step part. Therefore, even when the coin is positioned in a space expanding upward, the coin does not get stuck to provide an advantage that coin jamming does not occur.

If a coin dispensing signal is not output for a predetermined period of time under a circumstance in which a coin is supposed to be dispensed, the rotatable disk can be automatically reversely rotated for a predetermined period of time. In other words, if the dispensing signal of the coin does not exist for the predetermined period of time when the coin is supposed to be dispensed, it can be assumed that the rotatable disk is not rotated because of coin jamming.

When the rotatable disk is reversely rotated, the coin has to be rolled up onto the upper step part at once. As a result, a wobbling factor with respect to the coin is increased, and the coin readily falls down. Therefore, the coin readily drops to the through hole, therefore with an advantage that all of the coins including the last one can be quickly dispensed.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

In the present invention, a rotatable disk is provided with an upper step part and a lower step part, and the upper step part is moved so as to overthrow a lower part of any coin standing and leaning on an inner surface of a hopper head. As a result, the standing coin falls down onto the upper step part, moved to the upper side of a slope by the step, and is dropped into a through hole by its own weight. Alternatively, the coin may be moved to the upper side of the slope by a projection provided on the upper step part and dropped into the through hole by the weight of its own. Therefore, coins including the last remaining coin can be quickly dispensed.

Moreover, if the coin does not fall down even by the overthrowing by the upper step part, the rotatable disk can be reversely rotated. When reversely rotated, the coin is moved up onto the upper step part, therefore, wobbling of the coin is increased and the possibility of fall-down is increased so that the coins including the last one can be quickly dispensed.

[Embodiment]

Figure 1:
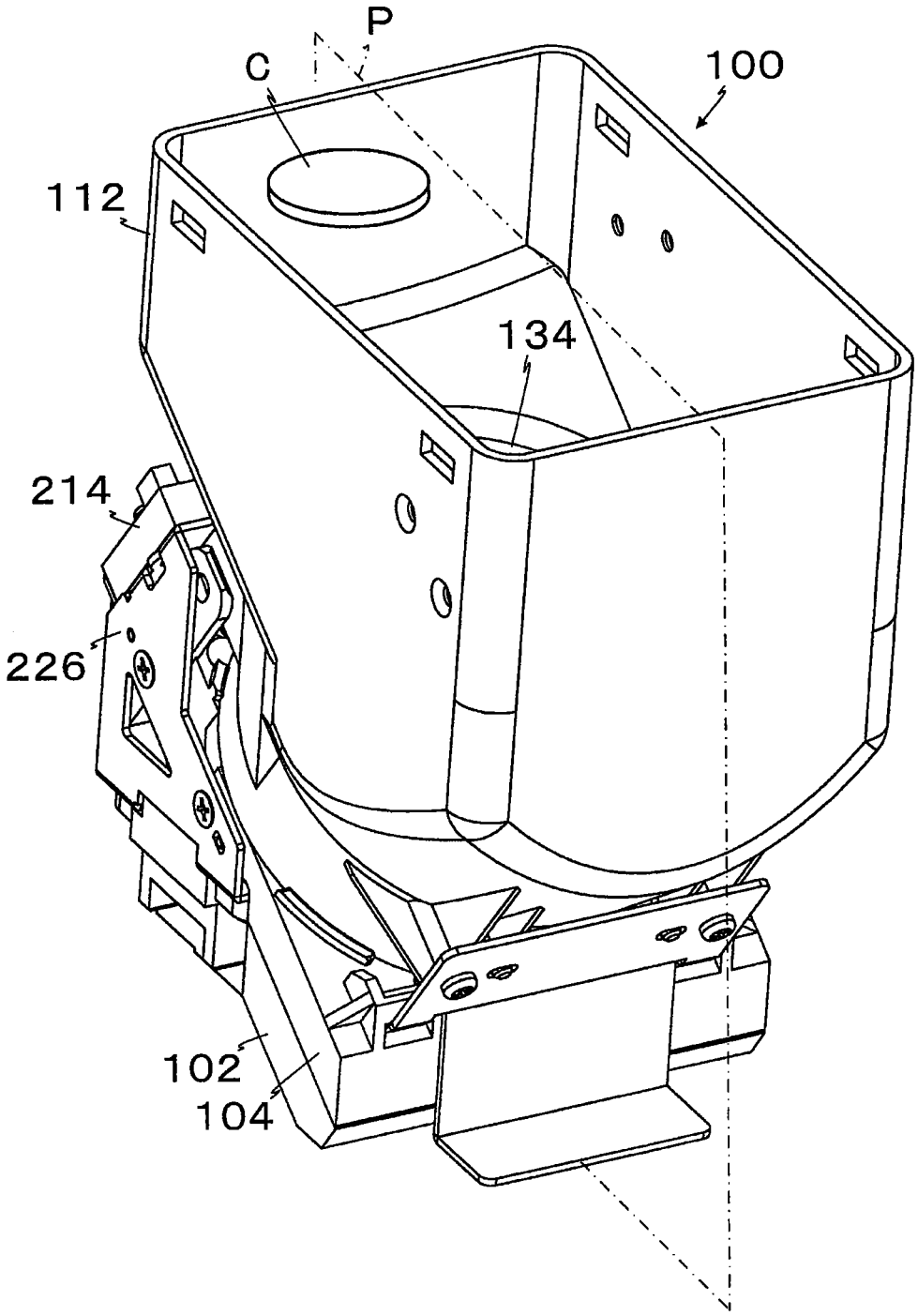
FIG. 1 is a perspective view of a coin hopper of an embodiment.
Figure 2:
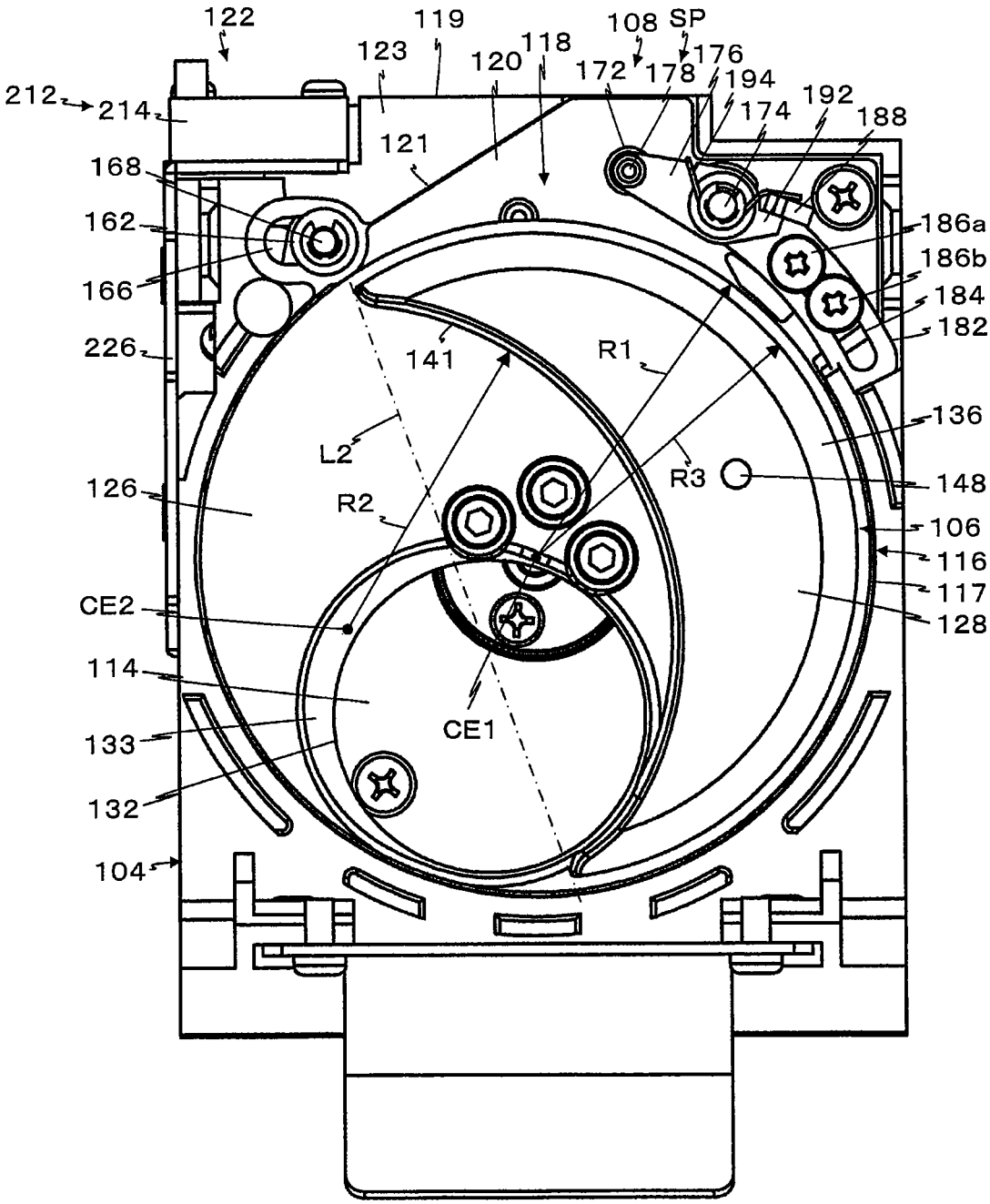
FIG. 2 is a front view of a rotatable disk in the state in which a hopper container head of the coin hopper of the embodiment is removed.

A coin hopper 100 according to the present invention has a function of dividing stored coins and dispensing coins C, which are held in bulk, one by one. As shown in FIGS. 1 and 2, the coin hopper 100 approximately includes a frame part 102, a base part 104, a rotatable disk 106, an ejection device 108, and a hopper head 112.

First, the frame part 102 will be explained with reference to FIG. 1 and FIG. 2. The frame part 102 has a function of supporting the base part 104, the rotatable disk 106, the ejection device 108, and the hopper head 112. The frame part 102 is formed by an injection molding of a resin and has a box-like shape which is approximately a right triangle in a lateral view, the vertex part thereof is inclined by about 30 degrees, and the frame part is approximately square in a planar view. In the frame part 102, an electric motor, etc. are mounted, as known in the art, for subjecting the rotatable disk 106 to a rotational drive mode of operation.

Next, the base part 104 will be explained with reference to FIG. 2. The base part 104 has a function of holding a slide base 114 of the coins C, the ejection device 108, and the hopper head or container 112. The base part 104 has a shape of a rectangular thick plate detachably attached to a vertex part of the frame part 102, and the base part can also be formed by an injection molding of a resin material to stabilize the container 112.

An approximately circular bottomed guide hole 116 having a diameter close to the entire width of the base part 104 is formed in the center of the upper surface of the base part 104. An opening is formed in part of the upper side of a slope of the base part 104 of a peripheral wall 117 of the guide hole 116 to form an outlet opening 118 for the coin C. A part of the outlet opening 118 of the guide hole 116 is formed in a trapezoidal shape 120, which is continued to an upper end edge 119 of the base part 104. An inclined surface 121 of the trapezoidal part 120 is inclined with respect to a left upper corner part 122 of the base part 104 in FIG. 2.

In order to improve wear resistance, a slide base 114 made of metal and formed to have a similar shape as the guide hole 116 and the trapezoidal part 120 fits therein, and the upper surface of the slide base 114 is formed to be flat with respect to an outlet upper surface 123 of the base part 104.

Figure 3:
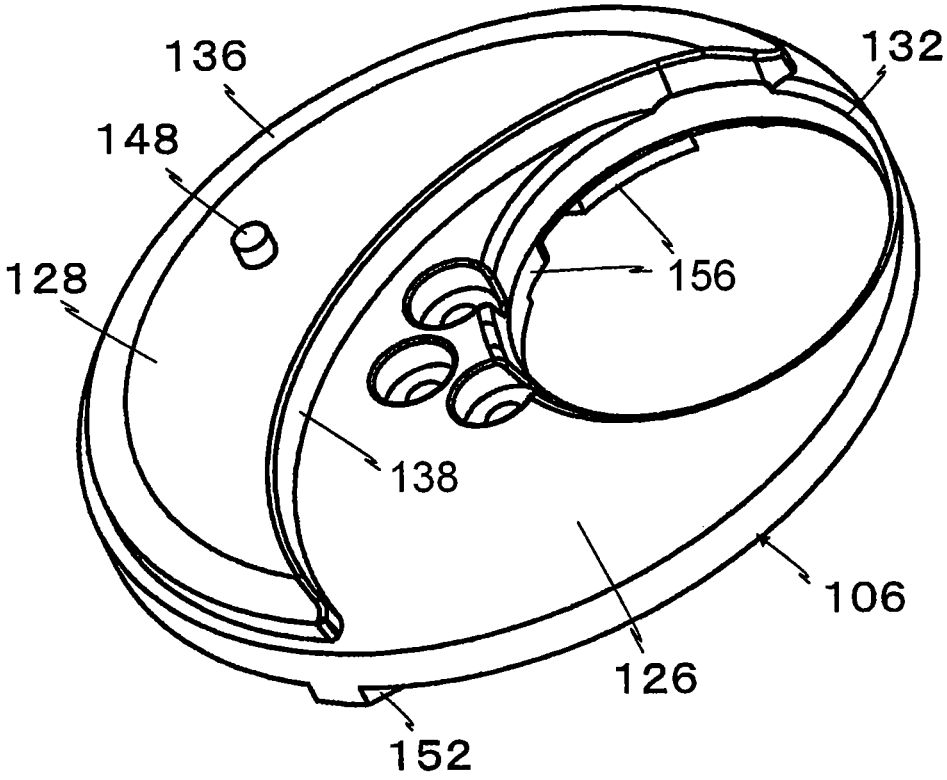
FIG. 3 is a perspective view of the rotatable disk of the coin hopper of the embodiment.

Next, the rotatable disk 106 will be explained with reference to FIG. 2 to FIG. 4. The rotatable disk 106 has the function of dividing and dispensing the coins C, which are held in the hopper head 112 in bulk, one by one. Specifically, the rotatable disk 106 is disposed in the vicinity of the upper surface of the slide base 114 to be parallel to the upper surface in a bottom hole 134 of the hopper head 112, which will be described later, and the rotatable disk 106 is rotated anticlockwise in FIG. 2 by the electric motor (not shown) built in the frame part 102 based on a dispensing signal of the coin C generated by a request to dispense coins. The anticlockwise rotation is referred to as forward rotation.

In the case in which a coin jamming occurs and the rotation disk 106 does not continue to rotate even though the electric motor is in a forward rotation mode or in the case in which the coin C is not dispensed for a predetermined period of time even though the ordered number of coins C have not been dispensed, in other words, in the case in which the ordered number of coins C are not dispensed and the coin C is not dispensed for the predetermined period of time, a reverse rotation (clockwise in FIG. 2) and a forward rotation again are repeated a predetermined number of times if the rotation of the electric motor is stalled and stopped. This can be automatically performed by a controller programmed to respond to this condition.

The rotatable disk 106 has a shape of a thin circular disk, in which a lower step part 126 and an upper step part 128 are formed. As shown in FIG. 4, the thickness T1 of the lower step part 126 is formed to be thinner than the thickness T2 of the upper step part 128. The thickness T1 has a distance from an upper surface of the slide base 114 to the upper surface of the lower step part 126, and the thickness T2 has a distance from the upper surface of the slide 114 to the upper surface of the upper step part 128.

The thickness T1 is preferred to be set to 3.5 millimeter or less. The reason therefor is to prevent the coins C from being laterally lined up at an approximately right angle with respect to the slide base 114 to become like a pillar in a through hole 132 and rotating together with the rotatable disk 106, in other words, to prevent the coin from not being dispensed. If the thickness T1 is 3.5 millimeter or less, the coin C can be supported by the periphery of the through hole 132 and is prevented from easily standing perpendicular to the slide base 114.

The lower step part 126 and the upper step part 128 are formed to be parallel to a lower surface 130 of the rotatable disk 126. This alignment is for reducing any rotation resistance of the rotatable disk 106 caused by the coin C. As shown in FIG. 2, the lower step part 126 is formed to have an elliptical (rugby ball) shape in a planar view and is at an eccentric position of the rotatable disk 106 and is the positioned where a part 131 of the outer periphery thereof is adjacent to the periphery of the rotatable disk 106. The single circular through hole 132 is found to penetrate the rotatable disk 106 from the upper surface to the lower surface. The diameter of the through hole 132 has a diameter slightly larger than the diameter of the coins C to be dispensed and is slightly smaller than the radius of the rotatable disk 106.

The peripheral surface 133 of the through hole 132 is formed to have a conical shape or meniscus shape which is upwardly enlarged in a plan view of FIG. 4(A). This is for facilitating a directional contact and dropping of the coin C into the through hole 132.

The upper step part 128 is formed to have a crescent shape at an eccentric position of the rotatable disk 106, and the periphery of the arc shape is formed on an inclined surface 136 having an angle of about 20 degrees as the angle X with respect to the extended line L1 of the upper step part 128 as shown in FIG. 4(B). In other words, an upper outer peripheral surface 140 of the upper step part 128 is partially formed to be conical.

The reason for employing the conical upper outer peripheral surface 140 in this manner is to prevent the coins C from easily standing and leaning on an inner peripheral surface of the hopper head 112. An inward arc edge 138 on a riser part 141 has a second radius R2 smaller than a first radius R1 of the rotatable disk 106 and forms an arc that has a center CE2 on the rotatable disk 106 adjacent to the through hole 132 as seen in FIG. 2.

In other words, a circular upper step part which is a base of the upper step part 128 is formed with a third radius R3 slightly smaller than the radius R1 of the rotatable disk 106, and the lower step part 126 is formed by elliptically removing part of the circular upper step part or by adding the crescent-shaped upper step part 128. The rotatable disk 106 can be a sintered metal object or a molded resin object, wherein the lower step part 126 and the upper step part 128 can be integrally formed together.

Figure 4:
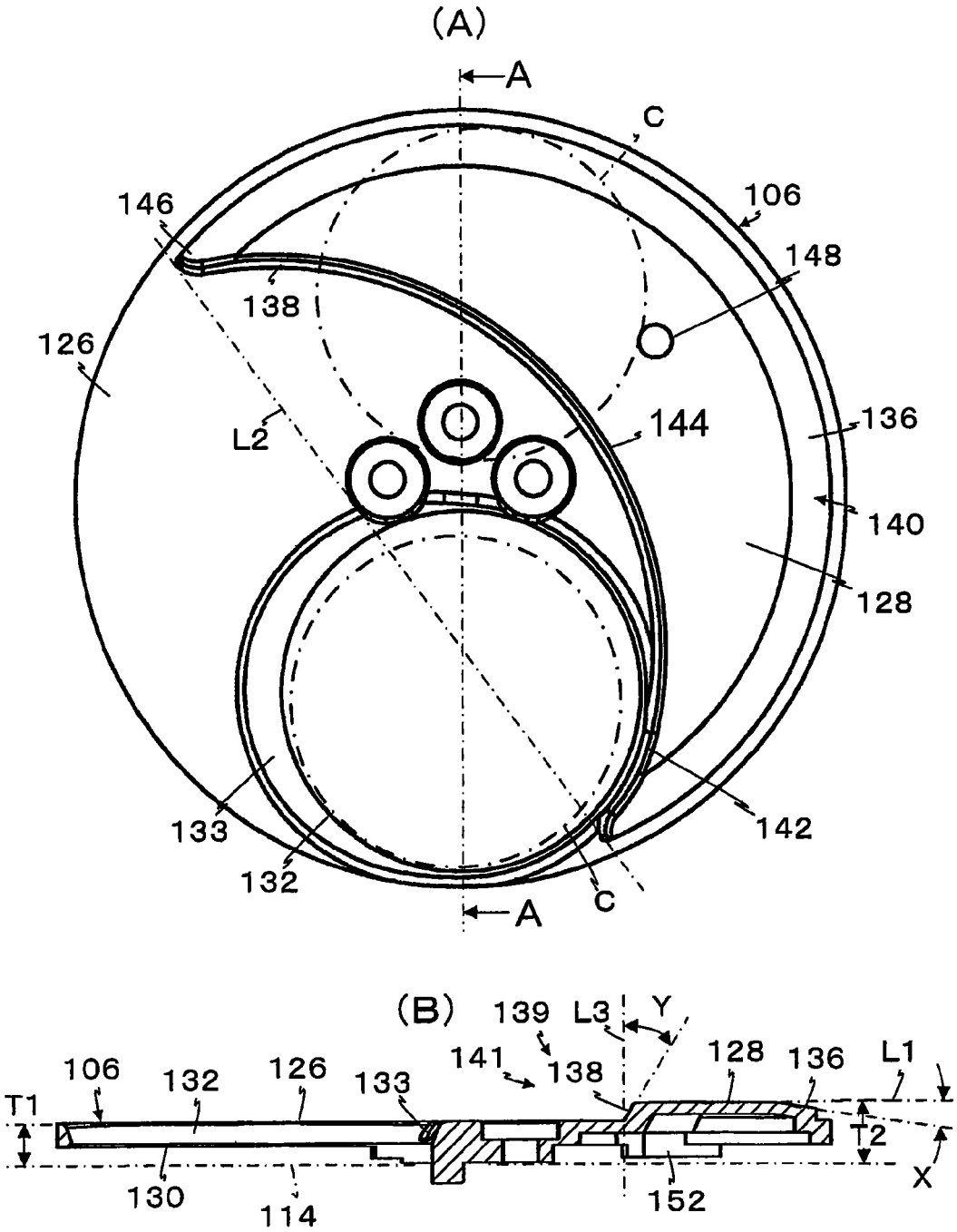
FIG. 4 shows the rotatable disk of the coin hopper of the embodiment, wherein (A) is a plan view, and (B) is a cross sectional view of the line A-A of (A).

As shown in FIG. 2 and FIG. 4, a right-side first end part 142 which is an end part of the crescent-shaped inward arc edge 138 is in contact with an edge of the through hole 132 in the vicinity of the periphery of the rotatable disk 106, an intermediate part 144 is positioned in the periphery side than the axial line CE1 of the rotatable disk 106, and a second straight line L2 connecting the end of a left-side second end part 146 with the first end part 142 is positioned in the side away from the upper step part 128 than the axial line CE1 of the rotatable disk 106.

In other words, the first end part 142 which is positioned in the back side of the forward rotation direction of the rotatable disk 106 is adjacent to the through hole 132 in the peripheral part of the rotatable disk 106. Therefore, when the coin C that is placed on the lower step part 126 so that the surface of the coin is in contact with the lower step part, the coin is positioned in the upper side of the slope with respect to the through hole 132, so the coin can slip off the upper surface of the lower step part 126 because of its own weight and be dropped into the through hole 132.

When the arc edge 138 is positioned above the horizontal line which passes through the axial line CE1 in the slope of the rotation disk 106, the coin C that is in contact with the lower step part 126 by the surface thereof and is caught by the arc edge 138 is rolled to the through hole 132 side by the slope of the arc edge 138 and gravity. The coin C rolled to the through hole 132 side is opposed to the through hole 132 at the first end part 142, at which the arc edge 138 is in contact with the through hole 132, and is dropped through the through hole 132.

The arc edge 138 is an inclined surface 139 for connecting a riser part 141 between the lower step part 126 and the upper step part 128. Regarding the angle of the inclined surface 139, the angle Y with respect to a line L3 which is perpendicular to the upper surface of the lower step part 126 is preferred to be about 15 degrees as shown in FIG. 4 (B). If the inclination is too small, the effect of agitating the coins C is small, and the coins C cannot be continuously dropped into the through hole 132. If the inclination is close to a right angle, an agitating force directly on the coin C may occur and there is a possibility that the coins C could be forcibly moved and may damage other parts such as the hopper head 112.

A cylindrical projection 148 is formed at the center of the upper surface of the upper step part 128. The center of the upper surface refers to the middle in the width direction and the longitudinal direction at the widest part of the crescent-shaped upper step part 128. The projection 148 has a cylindrical shape having a diameter of about 3 millimeters and has a height lower than the thickness of the coin C, and the upper end edge thereof is chamfered. The projection 148 can be made of metal and can be formed by press-fitting a lower end part thereof into a vertical hole bored in the upper step part 128, however, the projection can also be integrally formed with the rotatable disk 106. In the case in which the coin C is caught by the projection 148 and rotates together with the rotatable disk 106, if the coin C is positioned approximately above the slope, the coin C slips off the upper surface of the rotatable disk 106 and is dropped into the through hole 132.

On the back surface of the rotatable disk 106, a coin pushing portion 152 is formed so as to be adjacent to the through hole 132, and extends from the center part of the rotatable disk 106 to the periphery to form a convex-shaped involute curve extending in a forward rotation direction.

Therefore, when the rotatable disk 106 rotates forward, the coin C that has been dropped into the through hole 132 is turned anticlockwise in FIG. 2 while the coin is being pushed by the coin pushing portion 152, the periphery of the coin is being guided by the peripheral wall 117 of the guide hole 116, while the lower surface of the coin is being guided by the slide base 114.

In the vicinity of the outlet opening 118, the coin is guided to the outlet opening 118 side by a controlling pin 154 (see FIGS. 11 and 12) projecting above the slide base 114 and is ejected by the ejection device 108, which will be described later.

In the front side of the forward rotation direction of the through hole 132 on the back surface side of the rotatable disk 106, return projections 156 projecting downward are formed along the through hole 132. Therefore, when the rotatable disk 106 is reversely rotated, the coin C is pushed clockwise in FIG. 2 by the return projections 156 and is turned anticlockwise in FIG. 2 while the periphery thereof is being guided by the peripheral wall 117 of the guide hole 116 and the lower surface thereof is being guided by the slide base 114.

In the vicinity of the outlet opening 118, the coin C abuts the controlling pin 154, however, since the controlling pin 154 can be elastically moved backward into the slide base 114 as is known in the art, the coin C is turned together with the rotatable disk 106 without being guided to the outlet opening 118 side.

Next, the ejection device 108 will be explained with reference to FIG. 2. The ejection device 108 has the function of dividing and dispensing the coins C one by one. In the present embodiment, the ejection device 108 includes a fixed roller 162 and a moving roller 172. First, the fixed roller 162 will be explained. In the upper side of the slope of the base part 104, the fixed roller 162 is disposed to be adjacent to the guide hole 116 and is rotatably attached to an upper end part of a support shaft 168 penetrating through a long hole 166 formed in the base part 104.

The support shaft 168 is disposed in the back surface side of the base part 104, and is turnably supported by a fixing shaft (not shown) in a side below the rotatable disk 106, and is fixed to a lever (not shown) which is energized by a spring (not shown) clockwise in FIG. 2. The spring force can have an extremely large spring constant compared to a later-described spring 194 for ejection, and the fixed roller 162 is not moved upon normal dispensing of the coin C. However, when an extremely large force acts thereon, the fixed roller can be moved within the long hole 166 to prevent damage.

Next, the moving roller 172 will be explained. The moving roller 172 has the function of ejecting a coin C which has been pushed into a position between the moving roller 172 and the fixed roller 172 by the rotatable disk 106. The moving roller 172 is rotatably supported by a shaft 178, which is projecting downward from the end of a swing lever 176 rotatably supported by a second support shaft 174.

The second support shaft 174 projects upward from an end part of an arch-shaped position adjusting bracket 182 disposed to be adjacent to the guide hole 116 in a corner part of the base part 104, wherein the corner part is at a side opposite to the fixed roller 162. The position adjusting bracket 182 is fixed to the upper surface of the base part 104 by a pair of screws 186*a* and 186*b* which can penetrate through an arch-shaped long hole 184, is formed with a predetermined radius of which a center is the axial center of the rotatable disk 106. The screw 186*a* and 186*b* can be screwed into the base part 104. By virtue of this structure, positional adjustment can be carried out within the arch-shaped long hole 184 so that the moving roller 172 is positioned optimally in a relationship to the fixed roller 162 with respect to a diameter of the dispensed coin C.

A spring receiver 188 projects upward from an end part of the position adjusting bracket 182, and a second end 192 of the swing lever 176 abuts a lower end part of the spring receiver 188 and regulates the standby position SP (position of FIG. 2) of the moving roller 172 in a standby state.

An intermediate part of the helical spring 194 is wound around the outer periphery of the second support shaft 174, a first end thereof is caught by the swing lever 176, and a second end thereof is caught by the spring receiver 188, thereby imparting anticlockwise turning force to the swing lever 176 in FIG. 2. When the moving roller 172 is positioned the standby position SP, the distance from the fixed roller 162 is maintained at a distance smaller than the diameter of the coin C.

When the coin C is guided by the controlling pin 154 and is pushed into the position between the fixed roller 162 and the moving roller 172 by the coin pushing portion 152 of the rotatable disk 106, the swing lever 176 is turned clockwise in FIG. 2, and, immediately after a straight line that pass through the center of the coin C passes the contact points of the fixed roller 162 and the moving roller 172, wherein the coin C is ejected toward a later-described sensor 212 by the moving roller 172 based on the spring force of the helical spring 194.

Figure 5:
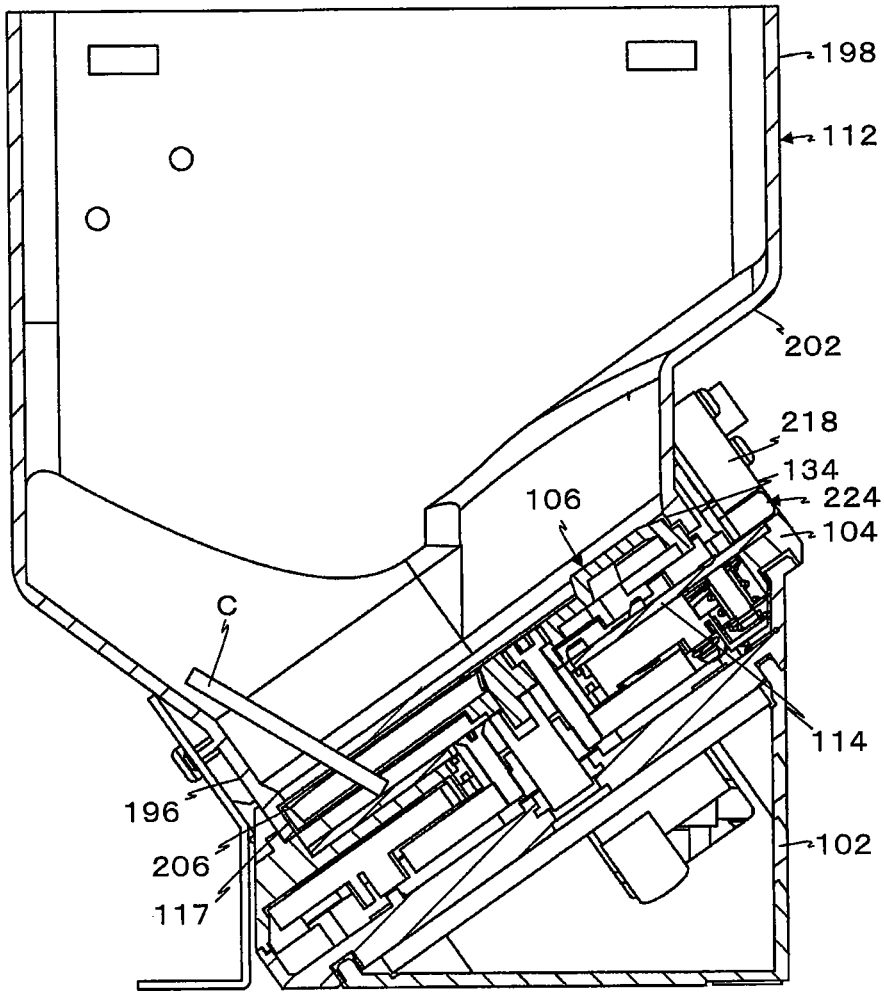
FIG. 5 is a vertical cross sectional view of the state in which a through hole of the rotatable disk is positioned in a lowermost part of a slope in a plane P of FIG. 1 of the coin hopper of the embodiment.
Figure 6:
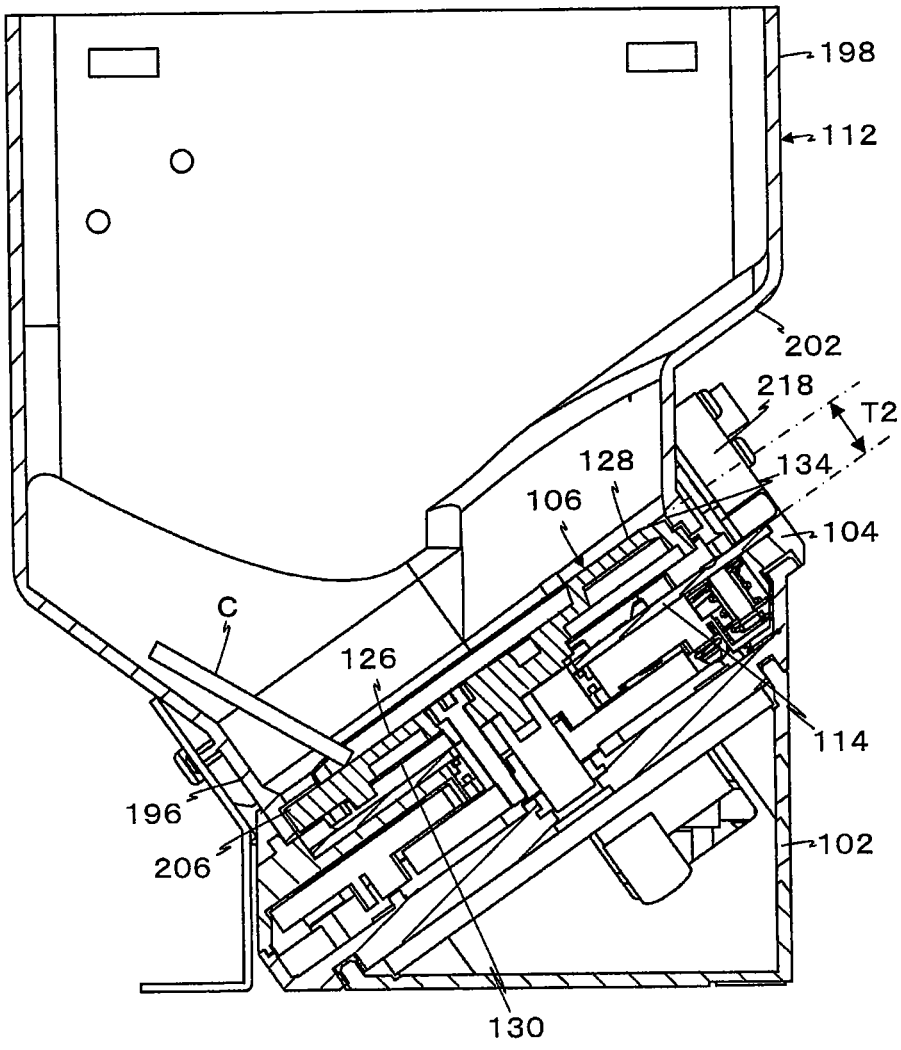
FIG. 6 is a vertical cross sectional view of the state in which the through hole of the rotatable disk is not positioned in the lowermost part of the slope in the plane P of FIG. 1 of the coin hopper of the embodiment.

Next, the hopper head 112 will be explained with reference to FIG. 1 and FIGS. 5 and 6. The hopper head 112 has the function of holding a predetermined amount of the coins C above the rotatable disk 106 in bulk. The hopper head 112 has a vertical tubular shape as a whole, with a lower end part 196 thereof formed to be circular, an upper end part 198 formed to be rectangular, and an intermediate part 202 is formed with an inclined surface so as to smoothly connect the upper end part 198 and the lower end part 196. The lower end part 196 is detachably fixed to the base part 104.

The rotatable disk 106 is disposed in the circular bottom hole 134 of the lower end part 196, and the inner peripheral edge of the bottom hole 134 projects to a position that is in contact with the through hole 132 above a peripheral end part 206 of the rotatable disk 106. This structure is for preventing the periphery of the coin C from being placed on the peripheral end part 206 of the rotatable disk 106 and dropping into the through hole 132.

A sensor 212 has the function of detecting the coins C which are ejected by the ejection device 108. The sensor 212 is, for example, a magnetic sensor 214 but other sensors, as known in the art, could be used. The magnetic sensor 214 permits the coins C to be detected without being affected by dust, etc. The magnetic sensor 214 has the shape of a lateral gate, and the sensor 214 is fixed to a metal bracket 226 mounted on a lateral surface of the frame part 102 so that the ejected coins C pass through a coin passage part 224 between an upper supporting part 218 and a lower supporting part (not shown) thereof.

Working of the present embodiment will be explained with reference also to FIG. 8 to FIG. 19. When the coin C is to be dispensed from the coin hopper 100, power is supplied to the electric motor, which is not shown, and the rotatable disk 106 is rotated anticlockwise in FIG. 2. By virtue of this rotation, the coins C in the hopper head 112 variously change their posture thereof because of the agitation by the through hole 132, the riser part 141 of the lower step part 126 and the upper step part 128, and the projection 148 so that a coin is dropped into the through hole 132.

In the process of rotation of the rotatable disk 106, the coin C can sometimes be sandwiched between the inclined surface 139 of the arc edge 138 and the inner surface of the hopper head 112, however, since it is an inclined surface 139, a lateral force can act on the coin at the contact part between the coin C and the inclined surface 139, and, when a predetermined force or higher is applied, the coin C can slide down the inclined surface 139. As a result, coin jamming can be avoided since the coin C does not get stuck between the inclined surface 139 and the inner surface of the hopper head 112.

When the coin C drops into the through hole 132, it is pushed by a coin pushing portion 152 while the lower surface of the coin C is being supported by the slide base 114. Therefore, the coin is turned anticlockwise while the peripheral surface of the coin C is being guided by the peripheral wall 117 of the guide hole 116. Subsequently, the coin C is contacted by the controlling pin 154 and is guided towards the outlet opening 118 and pushed into a space between the fixed roller 162 and the moving roller 172. Immediately after the center of the coin passes the straight line that is connecting the contact points of the fixed roller 162 and the moving roller 172, the pushed coin C is ejected toward the magnetic sensor 214 by the spring force imparted to the moving roller 172.

The ejected coin C is detected by the magnetic sensor 214. When a detection signal from the magnetic sensor 214 matches the ordered number of coins to be dispensed, rotation of the electric motor, and therefore, the rotatable disk 106 is stopped, and the dispensing of the coins C are finished.

A shown in FIGS. 5 and 6, the number of the coin C in the hopper head 112 is only the last remaining coin and the upper end part of the coin C may lean on the inner surface of the lower side of the slope of the hopper head 112, on the lower side of the slope of the slide base 114, and the lower end peripheral surface is standing with respect to the rotatable disk 106 and the slide base 114 as will be explained with reference to FIG. 7 to FIG. 15.

Figure 7:
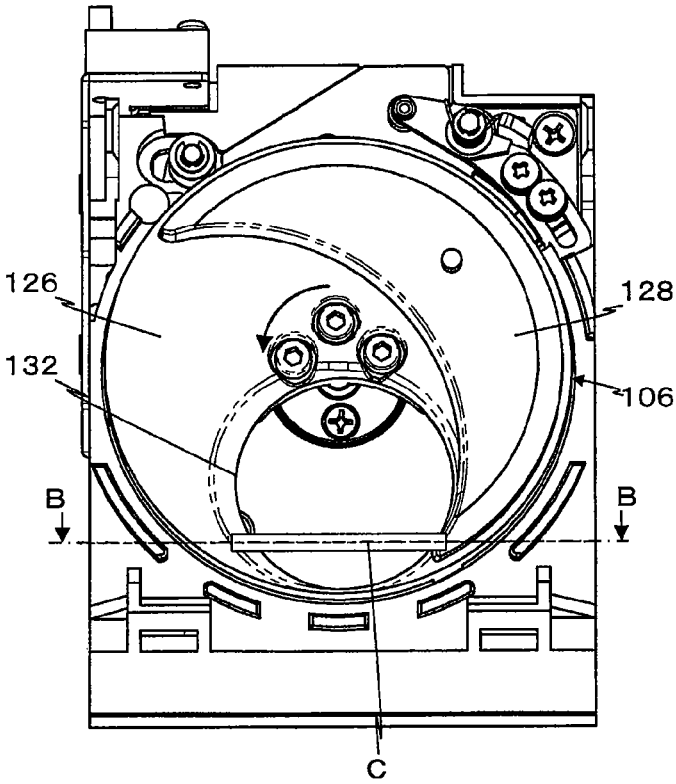
FIG. 7 shows the state in which the hopper head of the coin hopper of the embodiment is removed and the coin C is standing, wherein (A) is a front view of the rotatable disk, and (B) is a cross sectional view of the line B-B of (A).
Figure 7:
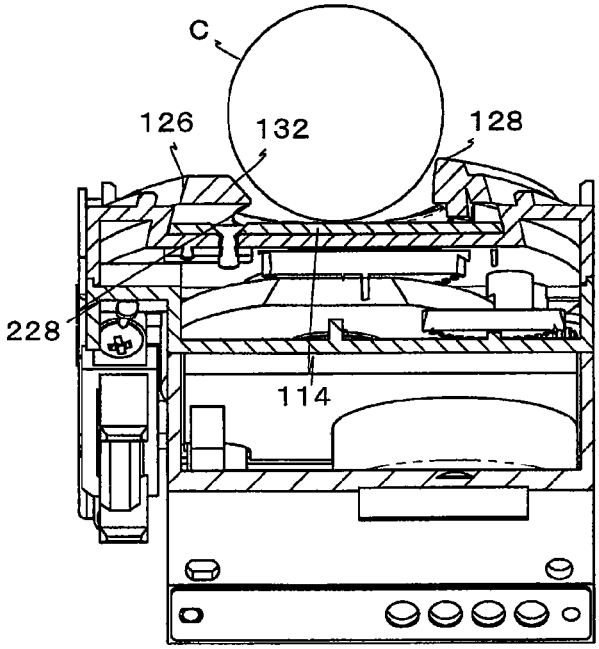

First, from the point at which the lower end of the coin C as shown in FIG. 7 (A) is dropped into the through hole 132 and supported by the slide base 114. The rotatable disk 106 is rotated anticlockwise, and the coin C is pushed up by an edge 228 of the through hole 132 as shown in FIG. 7 (B) and lifted up to the lower step part 126. In other words, the coin C is moved up onto the lower step part 126.

If the coin C has a small diameter in the process in which it is moved up thereon, the wobbling of the coin C caused when the coin is moved up onto the lower step part 126 is large since the height T1 is large with respect to the radius of the coin C, and the possibility that the coin falls down into the through hole 132 is high.

Figure 8:
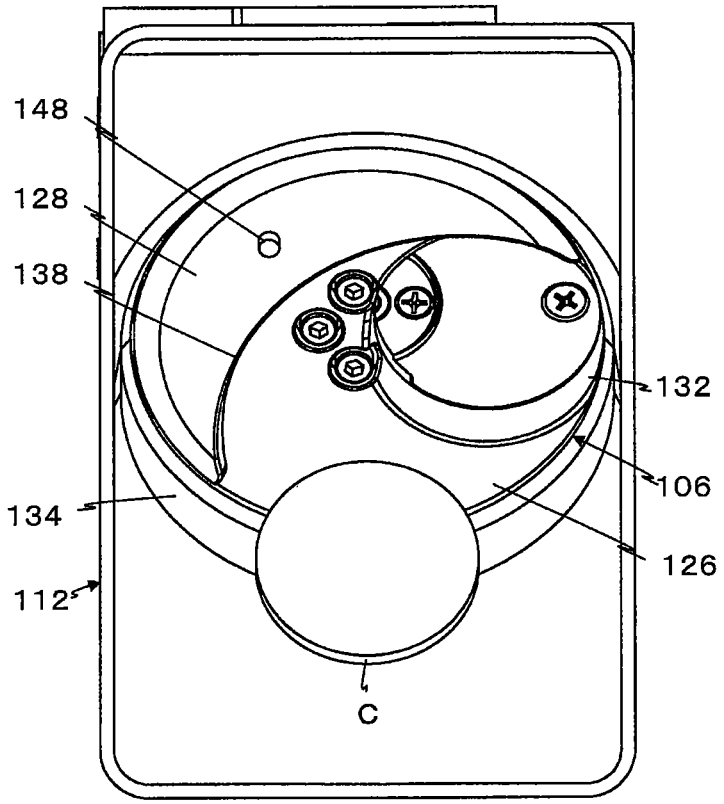
FIG. 8 is a plan view (step is positioned above the coin) for explaining working of the coin hopper of the embodiment.

However, if the coin C has a large diameter and the height T1 with respect to the radius of the coin C is small, the wobbling of the coin C caused when the coin is moved up onto the lower step part 126 is small. Therefore, even in the case in which the coin C is moved up onto the lower step part 126, there is a possibility that the coin remains standing, with the upper end part of the coin C leaning on the inner wall surface of the hopper head 112 as shown in FIG. 6 and FIG. 8.

In other words, since a conventional rotatable disk may be basically provided only with a lower step part although it has an agitation projection, the coin C sometimes can continue rolling in the bottom hole 134 of the hopper head 112 in the lower part of the slope of the slide base 114 and is not dispensed.

Figure 9:
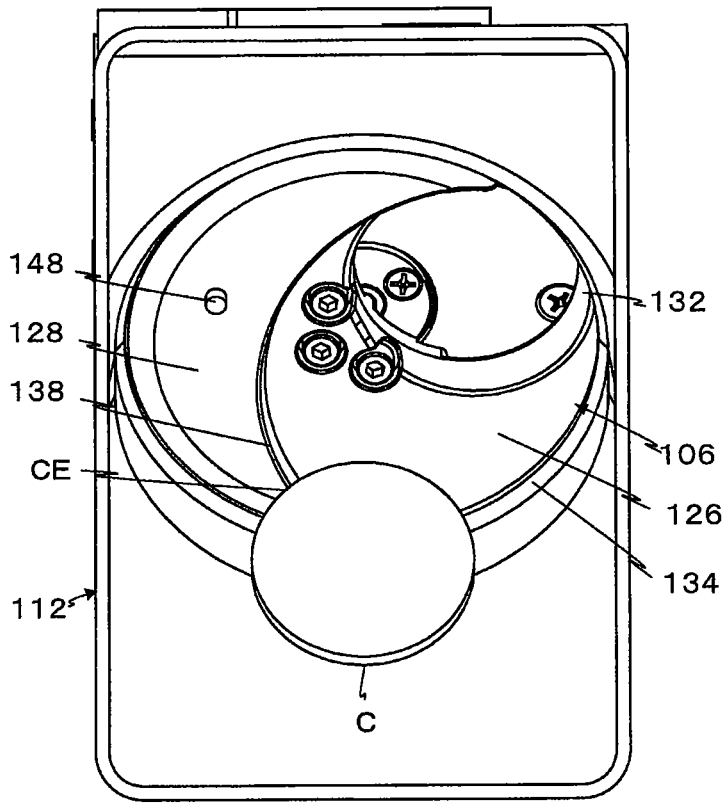
FIG. 9 is a plan view (the position where the step starts contacting the coin) for explaining working of the coin hopper of the embodiment.

The present invention is provided with an upper step part 128, therefore, the coin C is further moved up from the lower step part 126 to the upper step part 128 as shown in FIG. 9. Therefore, the probability that the coin C will fall down is increased by the wobbling of the coin C caused when it is moved upward.

Figure 10:
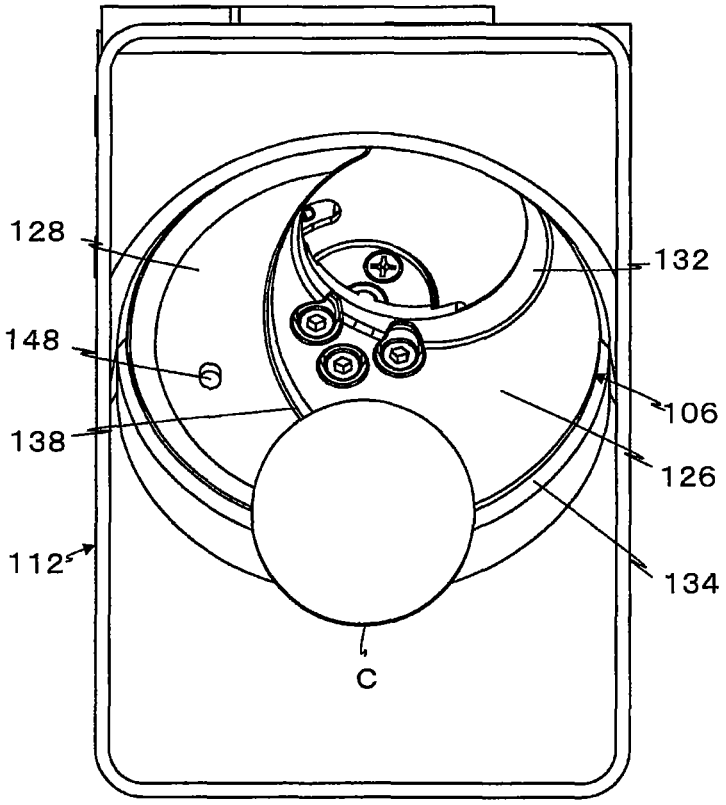
FIG. 10 is a plan view (the position where the step is pushing the back side of the lower part of the coin) for explaining working of the coin hopper of the embodiment.
Figure 11:
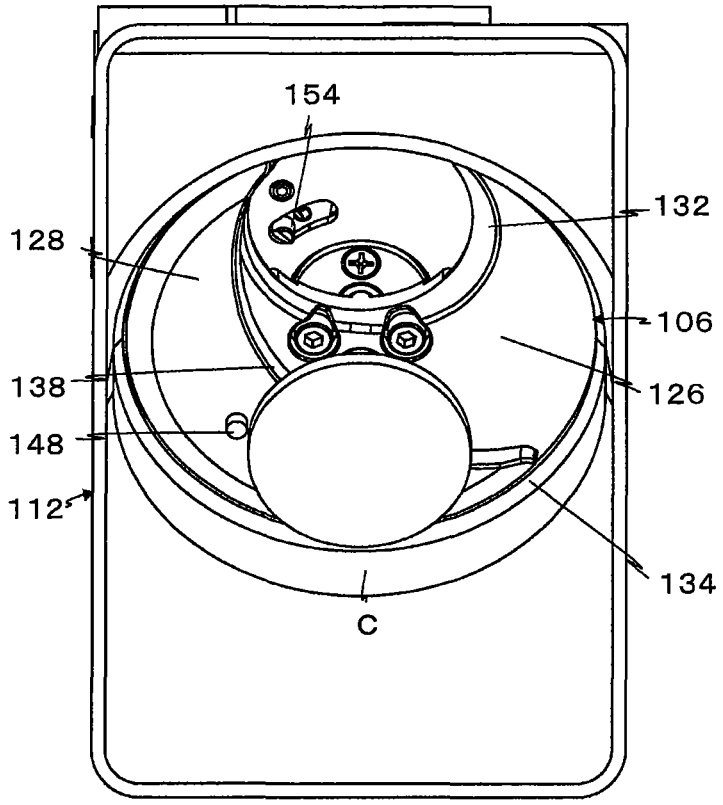
FIG. 11 is a plan view (the position where the coin is caused to fall down by the step) for explaining working of the coin hopper of the embodiment.

Moreover, when the coin is moved up from the lower step part 126 onto the upper step part 128, the inward arc edge 138 obliquely contacts the lower periphery CE of the coin C and as is clear from FIG. 9, the arc edge 138 is pushed from the back surface (inner surface of the hopper head 112) side of the coin C. As a result, the lower end part of the coin C is moved to a side of the axial line CE1 of the rotatable disk 106 by the arc edge 138. As a result, as shown in FIG. 10, the position on the inner surface of the hopper head 112 on which the upper end of the coin C leans sequentially approaches the bottom hole 134, and, finally, the coin lines up on the upper step part 128 as shown in FIG. 11.

If the coin C is not dropped into the through hole 132 without falling down, the magnetic sensor 214 will not output a detection signal for a predetermined period of time based on a predetermined count mode therefore, the electric motor is stopped, then subsequently reversely rotated for a predetermined period of time, and then rotated forward again. This operation can be performed automatically by an appropriately programmed controller (not shown).

When the rotatable disk 106 is reversely rotated, the rotatable disk 106 is rotated clockwise in FIG. 2. Therefore, as shown in FIG. 7 (B), the coin C has to be vertically moved up at once from the slide base 114 onto the upper step part 128. In other words, even in the case of a large-diameter coin C, the move-up in height is increased from T1 to T2, and the instability of the posture of the coin C upon the move-up is increased. As a result, the possibility that the large-diameter coin C falls down is increased.

Therefore, the possibility of dropping the remaining coin C in the hopper into the through hole 132 can be operatively increased by an action of overthrowing the coin C by the arc edge 138 upon forward rotation of the rotatable disk 106 and by the instability increasing action of the coin C caused when the coin is moved up at once from the slide base 114 onto the upper step part 128 upon reverse rotation of the rotatable disk 106.

Figure 12:
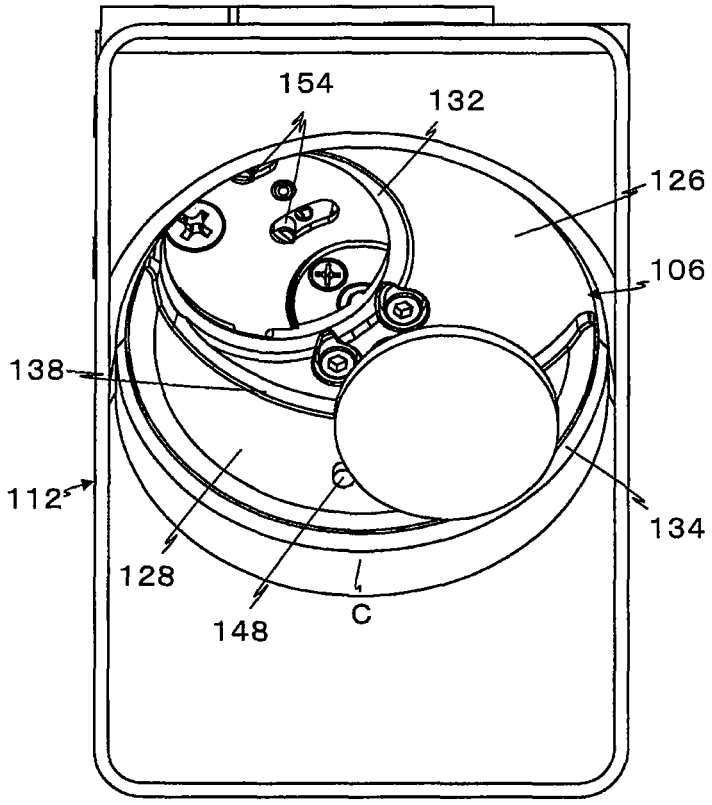
FIG. 12 is a plan view (the position where the projection starts moving the coin) for explaining working of the coin hopper of the embodiment.
Figure 13:
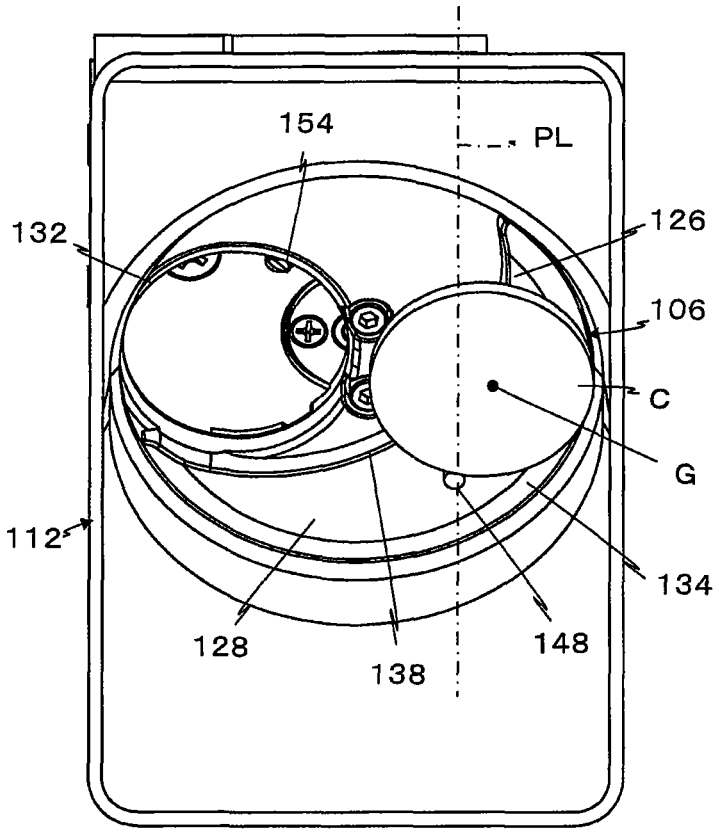
FIG. 13 is a plan view (the position where the coin is transversely juxtaposed to the through hole) for explaining working of the coin hopper of the embodiment.

Immediately after the coin C lies on the upper step 128 as shown in FIG. 11, the projection 148 is brought into contact with and pushes the peripheral surface of the coin C because of the further rotation of the rotatable disk 106 (see FIG. 12). Therefore, in the case in which the gravity center G of the coin C lying in the manner as shown in FIGS. 13 and 14 is positioned on a side close to the inner peripheral surface of the bottom hole 134 of the hopper head 112 with the perpendicular line PL passing through the projection 148, as the coin is moved anticlockwise while the periphery of the coin C is guided by the inner peripheral surface of the bottom hole 134.

Figure 14:
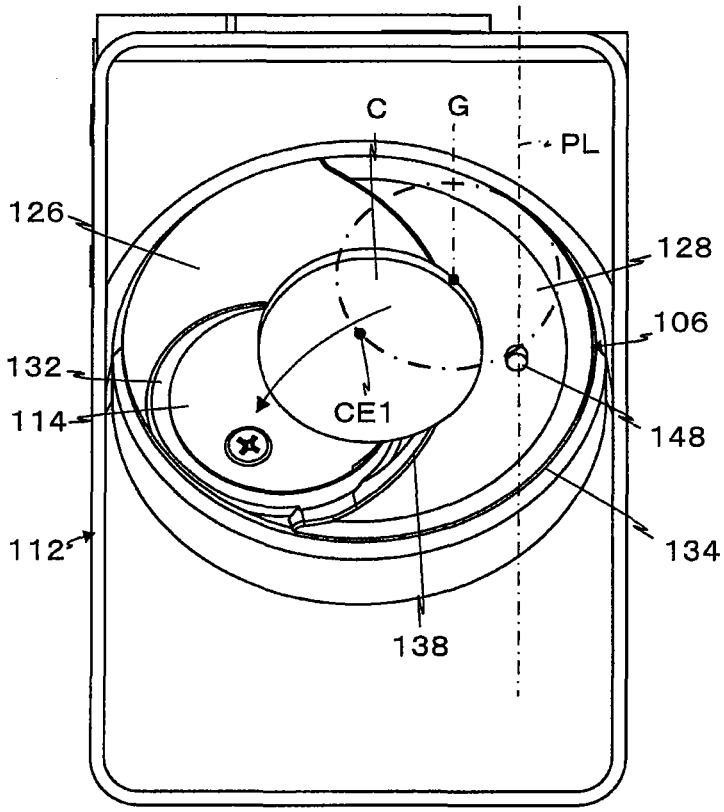
FIG. 14 is a plan view (the position where the coin starts rolling down due to gravity) for explaining working of the coin hopper of the embodiment.

The rotatable disk 106 is further rotated so that the gravity center G of the coin C lying on the upper step part 128 is positioned on the side close to the axial line CE1 of the rotatable disk 106 with the perpendicular line PL is shown in FIG. 14, and the coin C is then slipped off of the upper step part 128 because of gravity so the coin C will drop into the through hole 132.

When the coin C is dropped into the through hole 132, it is guided to an outlet opening 118 side by the controlling pin 154 in the above described manner and then ejected by the ejection device 108. In other words, all of the coins C held in the hopper head 112 including the last one can be dispensed with the present invention.

With reference to FIG. 15 to FIG. 18, a case in which the coin C lies on the lower step part 126 in the lower part of the slope of the slide base 114 will be explained.

Figure 15:
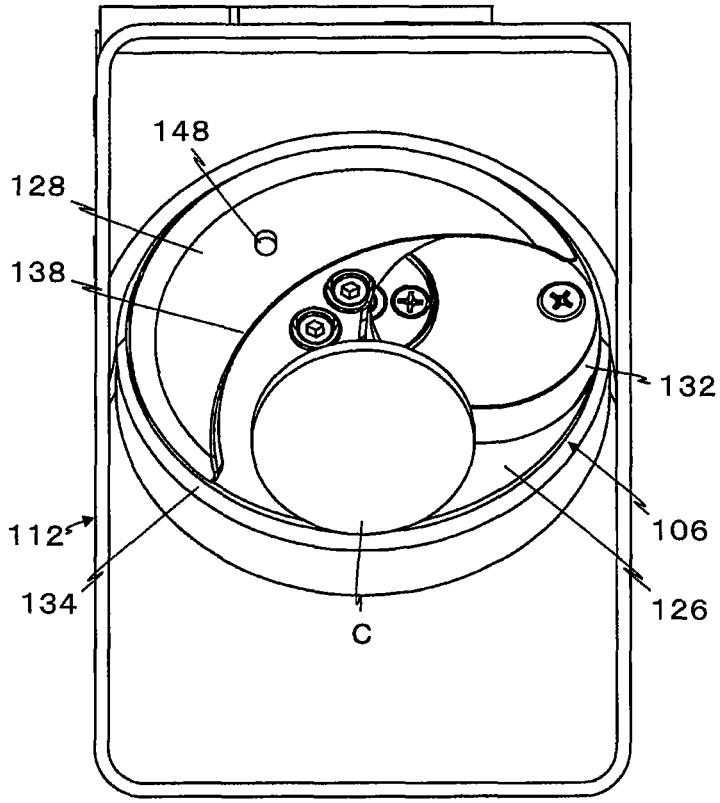
FIG. 15 is a plan view (the position where the coin lies on the lower step part) for explaining working of the coin hopper of the embodiment.

First, as shown in FIG. 15, in the case in which the coin C lies on the lower part 126, the coin C is positioned below the through hole 132, therefore, the coin is supported by the inner peripheral surface of the bottom hole 134 and is not dropped into the through hole 132 although the downward force along the slope is acting on the coin C on the lower step part 126 because of gravity.

Figure 16:
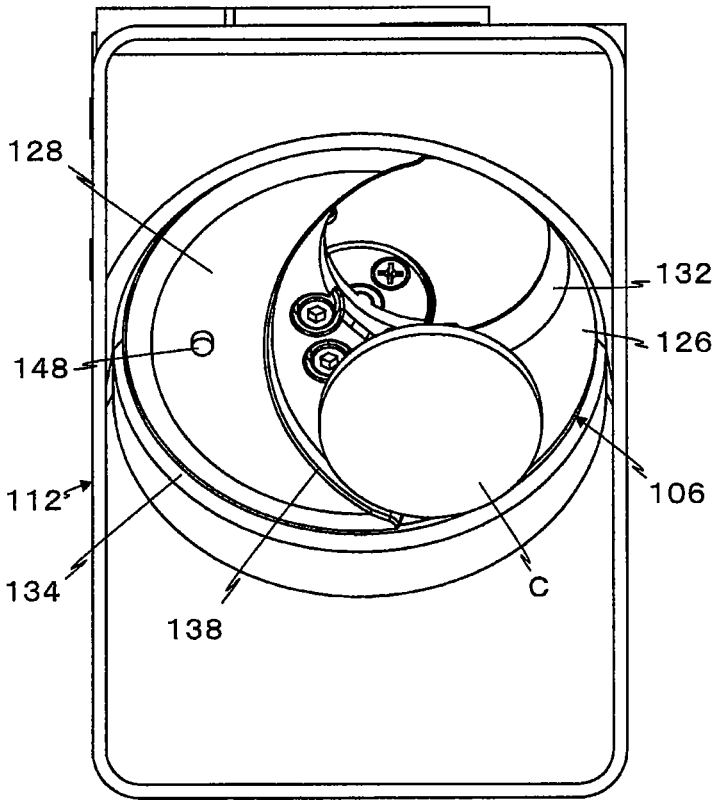
FIG. 16 is a plan view (the position where the step starts moving the coin) for explaining working of the coin hopper of the embodiment.

Subsequent rotation of the rotatable disk 106 causes the arc edge 138 to be brought into contact with the periphery of the coin C as shown in FIG. 16 and to push the coin C. In this case, the coin C is now guided by the inner peripheral surface of the bottom hole 134 and turned anticlockwise while being pushed by the arc edge 138. Also in this case, the through hole 132 is positioned on the side of the slope that is above the coin C, therefore, the coin C may not drop into the through hole 132.

Figure 17:
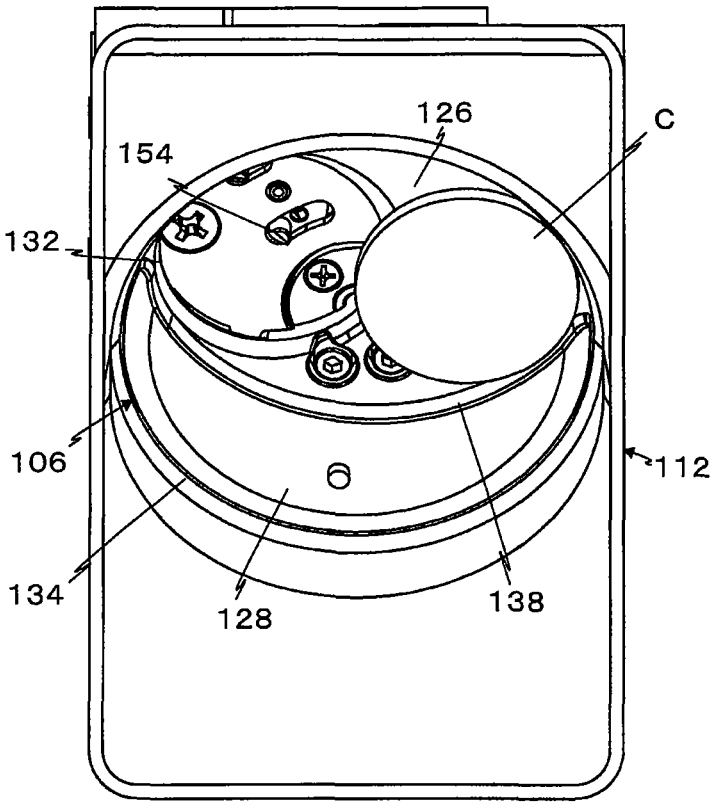
FIG. 17 is a plan view (the position where the coin is caused to be juxtaposed to the through hole by the step) for explaining working of the coin hopper of the embodiment.

When the subsequent rotation of the rotatable disk 106 causes the through hole 132 to be positioned in the lateral side of the coin C as shown in FIG. 17, the gravity that acts on the coin C generates a force towards the side of the axial line CE1 of the rotatable disk 106 because of the slope of the arc edge 138. However, this force is still small and cannot exceed the frictional force between the coin C and the lower step part 126. Therefore, the coin C is supported by the arc edge 138 and may stay at that position on the lower step part 126 while the peripheral surface of the coin is in contact with the inner peripheral surface of the bottom hole 134.

Figure 18:
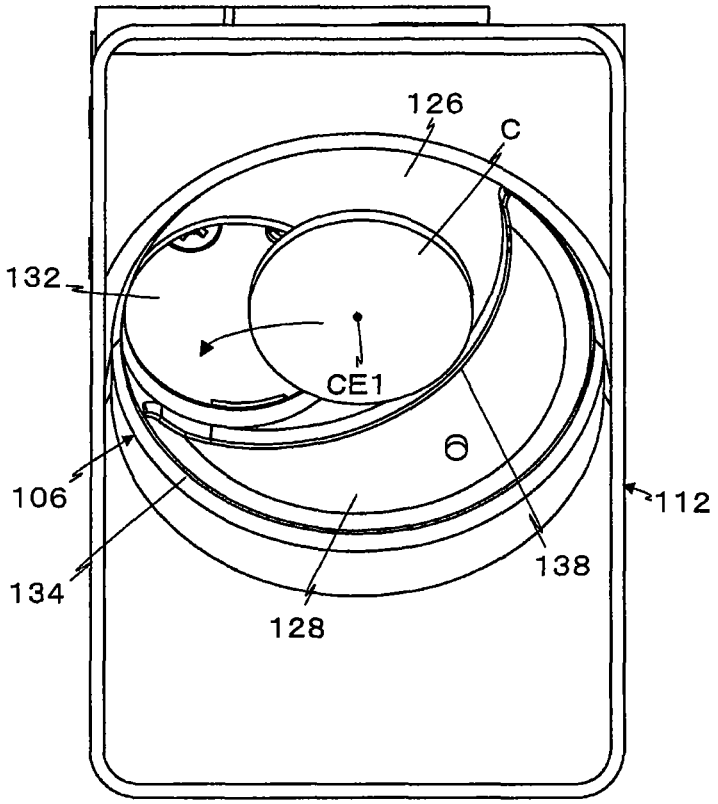
FIG. 18 is a plan view (the position where the coin starts rolling on the step) for explaining working of the coin hopper of the embodiment.

When the rotatable disk 106 is further rotated as shown in FIG. 18, the inclination of the arc edge 138 is now increased and therefore, the gravitational force towards the axial line CE1 side is increased and exceeds the frictional force between the coin C and the lower step part 126, and the coin C rolls into the through hole 132 side while being guided by the arc edge 138 because of the weight of the coin C per se. As a result, since the end part of the arc edge 138 is forming a tangent line with respect to the through hole 132, the coin is dropped into the through hole 132.

Then, after the coin is guided to the outlet opening 118 side by the controlling pin 154 in the above described manner, the coin is ejected by the ejection device 108. In other words, all of the coins C held in the hopper head 112 including the last one can be dispensed.

Figure 19:
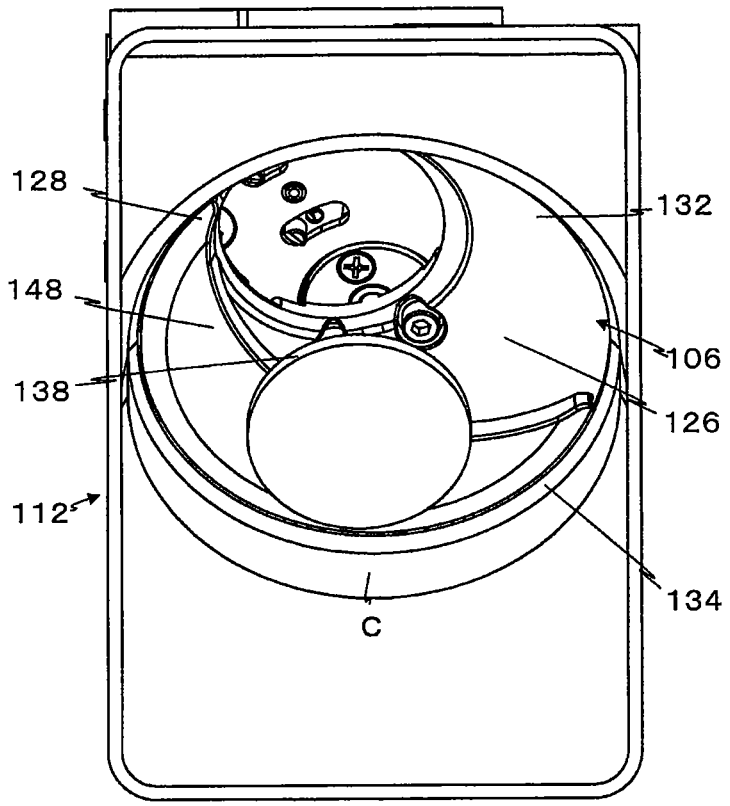
FIG. 19 is a plan view (the state in which the coin falls down on the projection) for explaining working of the coin hopper of the embodiment.
Figure 20:
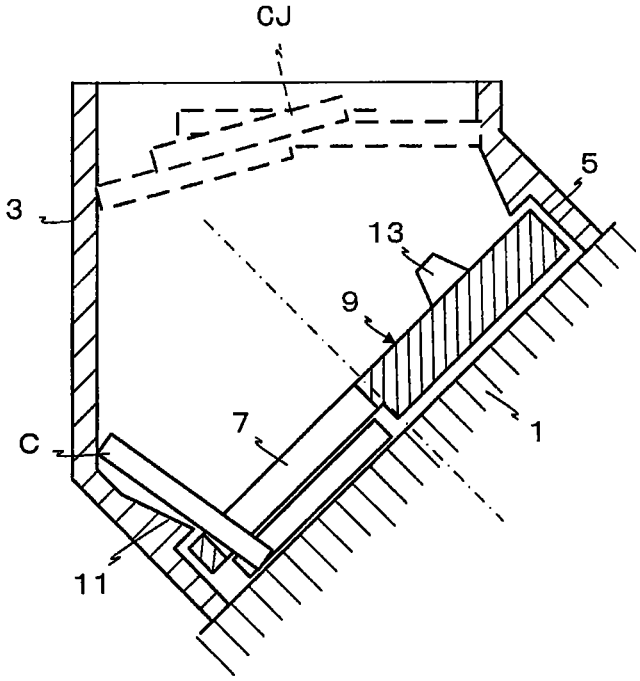
Fig.20 Prior Art
FIG. 20 is a cross sectional view for explaining a conventional coin hopper.

An example shown in FIG. 19 will be described for a case in which, corresponding to that of FIG. 11, the coin C does not fall onto the upper step part 128 before the coin C reaches the projection 148, but falls onto the projection 148. In this case, anticlockwise force acts on the coin C because of the frictional face with the vertex part of the projection 148, however, the force is still small, and the coin is approximately positioned in the lower part of the lower side of the slope of the rotatable disk 106.

Therefore, the projection 148 passes below the coin C, and the coin C lies on the upper step part 128 and, in the phase in which the through hole 132 is positioned in the lowermost side of the slope, the coin will be dropped into the through hole 132 and ejected by the ejection device 108 in the above described manner.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A compact coin hopper comprising:

a container for holding coins in bulk and having an opening for releasing coins by gravity;

a rotable disk, operatively positioned to receive coins passing through the container opening, having an upper surface and a lower surface with a through hole of a dimension to release coins from the container;

wherein the upper surface has at least an upper step part and a lower step part with a riser part extending between the upper step part and the lower step part, the through hole is formed in the lower step part and the riser part forms a crescent arc shape having a radius smaller than a radius of the rotating disk in a planar view with one end of the crescent arc shape terminating adjacent an edge of the through hole and another end of the crescent arc shape terminating adjacent a peripheral side edge of the lower step part offset from the through hole; and a slide base positioned below the rotable disk wherein the crescent arc shape directs coins to the through hole for sliding across the slide base for ejection from the coin hopper.

2. The compact coin hopper of claim 1 wherein a diameter of the rotable disk is less than two times a diameter of the through hole.

3. The compact coin hopper of claim 2 wherein a peripheral edge of the upper step part has a radial downward incline configuration elative to the upper surface.

4. The compact coin hopper of claim 3 wherein the rotable disk is mounted in the coin hopper to be driven in a clockwise and counter-clockwise direction to release coins.

5. The compact coin hopper of claim 1 wherein the planar surface area of the lower step part and the through hole form an oval configuration complimentary to the crescent arc shape of the upper step part.

6. The compact coin hopper of claim l wherein the radius of a concave portion of the crescent arc shape has a first axis adjacent an edge of the through hole and a radius of a convex portion of the crescent arc has a second axis adjacent the edge of the through hole offset by approximately 90° relative to a center of the through hole.

7. The compact coin hopper of claim 6 wherein the radii of the concave crescent arc shape and the convex crescent arc shape are respectively smaller than a radius of the rotable disk.

8. A coin hopper comprising:

a tubular hopper head holding a coin in bulk;

a rotable disk disposed in a bottom hole of the hopper head, having a through hole through which the coin can pass through from an upper surface to a lower surface and a coin pushing portion for contacting the coin, being inclined at a predetermined angle, and having a diameter approximately less than two times that of a diameter of the through hole; and a slide base disposed below and parallel to the rotable disk, the coin, pushed by the coin pushing portion, sliding on the slide base; wherein the rotating disk has an at least two-step structure of an upper step part and a lower step part having an inclined surface riser extending between the upper step part and the lower step part;

the through hole is formed at an eccentric positioned in the rotating disk, the through hole being formed in the lower step part, the riser forms an arc shape having a radius smaller than a radius of the rotating disk in a planar view and having a center offset from the through hole of the rotating disk so that the upper step part forms a crescent arc shape in a planar view, an end of the arc shape terminates at an edge of the through hole, and an intermediate part of the arc is disposed offset from an axis of the rotable disk.

9. The coin hopper of claim 8, wherein a projection is formed on the upper step part.

10. The coin hopper of claim 8, wherein the peripheral side of the upper step part is formed to be conical with an inclined surface with respect to a flat surface of the upper step part.

11. The coin hopper of claim 8, wherein, when a dispensing signal for a coin is not outputted for a predetermined period of time upon forward rotation of the rotating disk, the rotating disk is reversely rotated, in a reverse rotation, wherein the through hole is positioned ahead of the upper step part in the reverse rotation direction and the lower step part is positioned behind the through hole in the reverse rotation direction.

12. In a compact coin hopper for dispensing coins from a bulk coin storage container with a rotable disk operatively securing the coins and having a through hole for releasing a coin, the improvement comprising:

the rotating disk has at least a two-step structure of an upper set part and a lower step part having an inclined surface riser extending between the upper step part and the lower step part and the through hole is positioned offset from a rotational axis of the rotable disk, wherein the riser forms an arc shape having a radius smaller than a radius of the rotating disk in a planar view and having a center offset from the through hole of the rotating disk so that the upper step part forms a crescent arc shape in a planar view, an end of the arc shape terminates at an edge of the through hole, and an intermediate part of the arc is disposed offset from an axis of the rotable disk.

13. The compact coin hopper of claim 12 wherein a diameter of the rotable disk is less than two times a diameter of the through hole.

14. The compact coin hopper of claim 12 wherein the planar surface area of the lower step part and the through hole form an oval configuration complimentary to the crescent arc shape of the upper step part.

15. The compact coin hopper of claim 14 wherein the radius of the crescent arc shape has a first axis adjacent an edge of the through hole and a radius of a convex portion of the crescent arc has a second axis adjacent the edge of the through hole offset by approximately 90° relative to a center of the through hole.

* * * * *